United States Patent [19]

Johnson

[11] 3,949,629

[45] Apr. 13, 1976

[54] METHOD OF CUTTING AND STORING GARMENT-PATTERN SHAPED PIECES OF TEXTILE MATERIAL

[76] Inventor: Betty Johnson, 1928 Annin St., Philadelphia, Pa. 19145

[22] Filed: Jan. 24, 1975

[21] Appl. No.: 543,776

[52] U.S. Cl. ..... 83/27; 83/29; 83/451; 83/565; 33/17 R; 33/DIG. 1; 248/206 A; 335/285

[51] Int. Cl.[2] ..... B26D 7/06

[58] Field of Search ..... 33/17, 11, DIG. 1; 294/65.5; 248/206 A; 269/8; 83/451, 565, 27, 29; 335/285

[56] References Cited

UNITED STATES PATENTS

| | | | |
|---|---|---|---|
| 854,153 | 5/1907 | Dodds | 294/65.5 |
| 2,177,905 | 10/1939 | McKeehan | 335/285 |
| 2,411,328 | 11/1946 | MacNab | 33/17 R |
| 2,497,332 | 2/1950 | Teetor | 33/DIG. 1 |
| 3,009,375 | 11/1961 | Hardy | 83/29 |
| 3,091,459 | 5/1963 | Lindman | 335/285 |
| 3,726,165 | 4/1973 | Hendrickson | 33/11 |
| 3,827,020 | 7/1974 | Okamoto | 335/285 |

*Primary Examiner*—Richard E. Aegerter
*Assistant Examiner*—John W. Shepperd
*Attorney, Agent, or Firm*—Paul & Paul

[57] ABSTRACT

A novel method cutting textile material into garment-pattern shaped pieces using thin paper sheet pattern pieces utilizing magnetic objects to position and clamp the pattern pices to the textile. Further, a method of storing the cut textile is disclosed.

3 Claims, 7 Drawing Figures

METHOD OF CUTTING AND STORING GARMENT-PATTERN SHAPED PIECES OF TEXTILE MATERIAL

BACKGROUND OF THE INVENTION

The present invention relates to methods of cutting textile material into garment-pattern shaped pieces, and more particularly the cutting of such pieces from thin paper sheet pattern pieces on which is inscribed a cutting line which conforms to the desired shape of the pieces to be cut. Fabrication of garments from paper sheet pattern pieces of this kind is quite common, particularly as practiced by housewives or househusbands at home using commercially available pattern pieces.

In the prior art, the common way in which such pattern pieces were employed in the fabrication of a garment was to use a plurality of straight pins which were forced through the pattern and the cloth in order to hold the pattern piece in association with the cloth during cutting. The use of these straight pins was subject to many disadvantages, particularly in that the thinness of the thin paper sheet pattern pieces and of many textile materials to be cut led to a ripping of the pattern piece and a pulling or marring of the surface of the material to be cut. With the advent of knits and double knit fabrics, the problem experienced in pinning pattern pieces to material of this kind has been greatly increased. Additionally, the now common use of bold plaid fabric designs in many garments makes the job of precisely positioning these pattern pieces with respect to the plaids far more difficult than the same method when practiced on a solid fabric or on a fabric featuring a small repetitive design. Consequently, in order to match the plaids between adjacent pattern pieces in a finished garment, it has now become necessary to more precisely position and hold the pattern pieces prior to and during the cutting operation.

A second drawback of the prior pinning operation was that, due to the tendency of the thin paper pattern sheet to rip and to buckle, many pins were needed to be used across the entire face of the thin paper pattern piece in order to ensure a smooth and even laying down and holding of the pattern piece to the material. Since the fabrication of garments often requires that various puckers or folds, which in the art are called "darts", be sewn in individual fabric pieces, most thin paper sheet pattern pieces indicate the location of dart lines on their surface. These dart lines differ from pattern lines in that no cutting along these lines is intended. Nonetheless, since following the cutting operation, the thin paper pattern piece is normally removed from the material, it is necessary to mark these dart lines by some means on the fabric. According to one method, one end of the thin paper sheet pattern piece is pinned to the fabric while the home sewer lifts up the other end repeatedly, estimating the position of the dart line with respect to the face of the fabric, and marking the fabric with pins. This method of marking dart lines on the fabric is, however, very approximate and does not usually produce a satisfactory result. A second alternative method which has gained some acceptance is the use of tracing paper together with tracing wheels. According to this method, sheets of tracing paper are placed between the pattern and the fabric to be marked and a marking wheel is run over the top of the pattern so that its depression along the dart line will produce a similar image on the fabric. Heretofore, the use of tracing paper in the cutting of fabrics has been disadvantaged by the fact that many pins were required across the entire surface of the paper, making it impossible to slide the tracing paper between the layer of fabric and the thin paper sheet pattern piece without laborious unpinning and repinning in order to ensure that the pattern piece does not slide with respect to the underlying fabric.

Additionally, prior art methods of pinning and cutting fabric pieces left as an end result composite fabric pieces with a plurality of pins protruding therefrom. Since each piece of textile material is identified by the markings appearing on the thin paper sheet pattern piece which is pinned thereto, it is not normally desirable to remove the thin paper sheet pattern piece from the fabric prior to incorporating the fabric into the garment. Since it is usually desirable to lay out and cut an entire garment prior to beginning the fabrication process, the result of this prior art cutting method is the compilation of a plurality of composite fabric pieces. The storage of these pieces prior to the fabrication of the garment is hampered by the fact that the pins protruding therefrom are likely to tear the adjoining paper sheet pattern piece if the sewer attempts to stack these composite pieces on one another. Of course, when fragile fabric is employed, this problem is magnified by the likelihood of pulling or otherwise marring the textile fabric. Therefore, it is not uncommon for a sewer to individually spread each of the garment-pattern shaped composite pieces around the working area in order to avoid this problem. Unfortunately, while reducing the likelihood of pin damage, this method has the further drawback of exposing the textile material to soiling. Heretofore, no prior art method has provided a satisfactory means of storing these composite fabric pieces prior to their incorporation in the completed garment.

Recently, some of the disadvantages discussed above with respect to the precise positioning of thin paper sheet pattern pieces on the textile material have been overcome through the use of magnetic objects and magnetically attractable objects which grip the thin paper sheet pattern pieces therebetween. By using two of these gripping sets to grip the thin paper sheet pattern piece it is possible is exert divergent forces along the plane of the pattern and then to place the pattern on the material. Unfortunately, this method of positioning a pattern piece with respect to the material does not aid in the cutting of that material since there is no positive engagement between the thin paper sheet pattern piece and the material itself. This method of adjusting a pattern with respect to a textile material prior to cutting is described in my U.S. Pat. No. 3,837,084 which issued on Sept. 24, 1974.

SUMMARY OF THE INVENTION

I have overcome the disadvantages of the prior art by providing a readily useful means and method of permanently retaining and adjusting a pattern on a piece of cloth during the cutting operation. Generally, my invention comprises an eight-step method which employs at least four magnetically attractable objects and at least four magnetic objects which are used in conjunction with the textile material, a horizontal planar cutting surface, and the thin paper sheet pattern piece to facilitate the simple and safe positioning of a thin paper sheet pattern piece with respect to a fabric prior to and during the cutting operation. A first alternate embodiment of my invention increases the gripping power and gripping area employed to hold the thin paper sheet pattern pieces against the material by providing that a plurality of magnetic objects be used in conjunction with each magnetically attractable object. A second alternate embodiment provides that the magnetically attractable object be a substantially planar magnet. A third alternate embodiment of the present invention provides a novel method of storing the composite pattern pieces in a vertical position prior to their incorporation in a finished garment.

A primary object of the present invention is the provision of a method of cutting garment-pattern shaped pieces of textile material using thin paper sheet pattern pieces without endangering the integrity of either the thin paper sheet pattern pieces or of the textile material itself. Another aim of the present invention is the provision of a method which allows the easy marking of dart lines on material. A further aim of the present invention is the provision of a novel storage method which allows composite pattern pieces to be stored without risk of damage or soiling prior to their incorporation in the finished garment. These and other objects of the present invention will become apparent from the following discussion.

DESCRIPTION OF THE PREFERRED EMBODIMENTS

Figure 1:
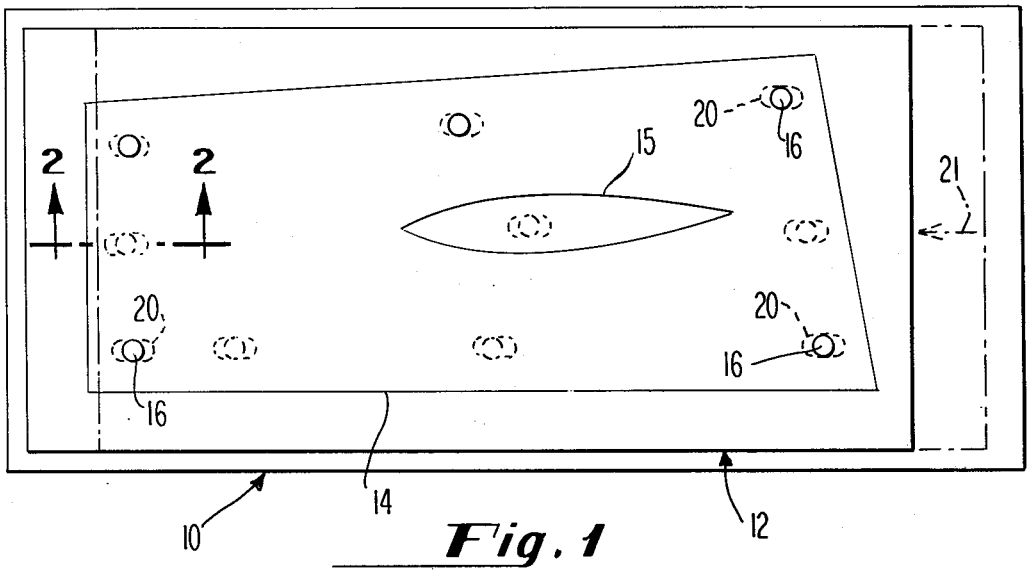
FIG. 1 is a plan view of a pattern and sheet of textile material showing a plurality of magnetic objects and magnetically attractable objects in accordance with one of the preferred embodiments of the present invention, the original positions of both the pattern and the magnetic and magnetically attractable objects being shown in phantom.

Although specific forms of the invention have been selected for illustration in the drawings, and the following description is drawn in specific terms for the purpose of describing these forms of the invention, this description is not intended to limit the scope of the invention which is defined in the appended claims.

Referring to the figures, FIG. 1 is a plan view showing the textile material, designated generally 10, the thin paper sheet pattern piece designated generally 12, and a plurality of magnetic objects 16 each of which is associated with a magnetically attractable object 20. As illustrated in this figure, the textile material 10 may be any of the types of fabric normally used to construct finished garments, and particularly, in accordance with the method of the present invention, may be particularly flimsy or delicate fabrics such as open weaves, silks, or other fragile materials. The thin paper sheet pattern piece, designated generally 12, may be seen to have inscribed thereon a cutting line 14, and a dart line 15.

Figure 2:
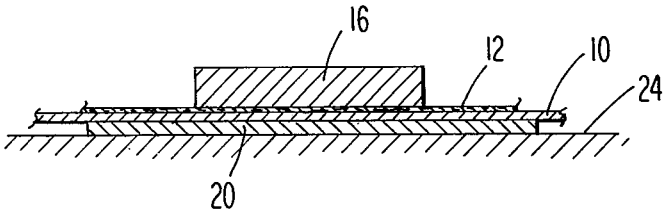
FIG. 2 is a cross section on an enlarged scale of the embodiment shown in FIG. 1, taken as indicated by the arrows 2—2.
Figure 3:
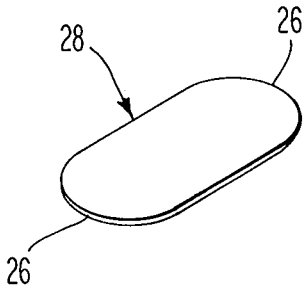
FIG. 3 is a perspective view of the magnetically attractable object shown in section in FIG. 2.

FIG. 2 is an enlarged cross section taken along the line 2—2 as shown in FIG. 1. This enlarged cross section reveals the cutting surface 24, the magnetically attractable object 20, the textile material 10, the thin paper sheet pattern piece 12, and the magnetic object 16. As shown in FIGS. 1, 2, 3, 5, 6, and 7 the magnetically attractable object 20 is an oval shaped plate composed of iron, stell, or other material which may be attracted by a magnetic force. FIG. 3 is a perspective view of such a plate 28 which is substantially planar but of such a mass as to provide a significant force when attracted by the magnetic object 16. Each plate 28 has two end portions 26 which are rounded in order to prevent the marring or cutting of either the textile material 10 or of the cutting surface 24.

Figure 4:
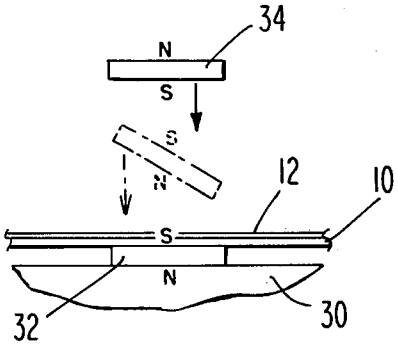
FIG. 4 is a side view of a second preferred embodiment of the present invention which illustrates the flipping motion of the magnetic object which might occur when the magnetically attractable object is a substantially planar magnet.

Referring now to FIG. 4, an alternate embodiment of the present invention employing a magnet 32 as the magnetically attractable object is seen in association with a cutting substrate 30 which is partially broken away, the textile material 10, the pattern 12, and the magnetic object 34. It can be seen from FIG. 4 that the magnetic poles of both the magnetic object 34 are oriented axially. As shown in all of the figures, the magnet 32 and the magnetic objects are substantially planar and of cylindrical cross section.

Referring now to FIGS. 1 through 4, it can be seen that the present invention provides a method of cutting the textile material 10 into garment-pattern shaped pieces by using the thin paper sheet pattern pieces 12 having a cutting line 14 inscribed thereon which conforms to the desired shape of the pieces to be cut. In accordance with the method of the present invention, at least four magnetically attractable objects 20 are placed on the planar, substantially horizontal cutting surface 24 so as to define an area which is substantially less than the area of the textile material 10 to be cut. While it is anticipated that at least four distinct substantially planar magnetically attractable objects should be employed, where the garment-pattern shaped pieces to be cut is large, it is anticipated that many more magnetically attractable objects would be desirable. After placing these magnetically attractable objects on the cutting surface 24, the textile material 10 is then placed over the magnetically attractable objects 20 so that those magnetically attractable objects 20 are sandwiched between the textile material 10 and the cutting surface 24. Next, the thin paper sheet pattern piece 12 is positioned and placed directly over the magnetically attractable objects on top of the material directly in planar association therewith as shown in phantom in FIG. 1. The thin paper sheet pattern piece 12 is then released and a plurality of magnetic objects 16 are selected, at least one for each magnetically attractable object, for placement on the surface of the thin paper sheet pattern piece 12 by first juxtaposing each magnetic object axially at a distance of at least one inch from each of said magnetically attractable objects 20 and then successively releasing each of said magnetic objects 16, thereby allowing each of said magnetic objects to re-orient itself during the gravitationally induced movement of each magnetic object towards each magnetically attractable object such that the magnetically attractable objects and magnetic objects are attracted to each other and grip the textile material and thin paper sheet pattern piece therebetween, as illustrated in FIG. 2. This axial positioning releasing and re-orientation during the gravitational movement of the magnetic object is clearly illustrated in FIG. 4. In that figure, the magnetic object 34 is shown to be precisely axially positioned with respect to the magnetically attractable object, which in that figure is shown to be a magnet 32. In the normal instance where a plate 28 is used as the magnetically attractable object 20, no flipping motion would be experienced during the fall of the magnetic object 34. There would, however, be a general lateral re-orientation of the magnet during its fall with the resultant alignment of the magnetic object directly over the magnetically attractable object 20 as shown in FIG. 1.

In one alternate embodiment of the present invention, in order to increase the gripping power which is exerted upon the pattern 12 and the textile fabric 10, the magnetically attractable object 20 is a magnet 32 as shown in FIG. 4. In this instance, the axial positioning, releasing an resultant fall of the magnetic object 34 may result in a flipping motion which produces a polar repositioning of the magnet prior to the gripping of the pattern 12 and textile fabric 10 therebetween. Thus, the step of successively releasing each of said magnetic objects from a position at least one inch from each of said magnetically attractable objects allows a polar as well as lateral re-orientation of the magnetic object 34 during its fall to the surface of the thin paper sheet pattern piece 12.

Once the previous steps have been accomplished, it is necessary then to reposition the thin paper sheet pattern piece 12 with respect to the textile material 10 in order to precisely align the cutting line 14 with respect to the bias, grain and pattern which may normally be found in the textile material. Additionally, the dart line 15 may need to be repositioned so that the folding and subsequent sewing along these dart lines results in a pleasing aesthetic product. Consequently, the next step in the method of the present invention is the gripping with one hand of the textile material along a portion of the material which opposes the direction of the desired movement of the thin paper sheet pattern piece 12. Using the other hand, the thin paper sheet pattern piece is gripped and drawn by applying a substantially divergent force on the pattern piece sufficient to bring the pattern piece to the desired cutting location. Referring now to FIG. 1, the application of this divergent, substantially planar force is illustrated with an arrow 21 showing the movement of the pattern piece from the original position, shown in phantom, to the final position. During the repositioning of this pattern piece through the exertion of this divergent force, the magnetic objects and magnetically attractable objects, shown in their original positions in phantom in FIG. 1, will not assume a different orientation with respect to the textile material 10. Consequently, the magnetic object 16 and magnetically attractable objects 20 are then repositioned by slightly lifting the textile material and thin paper sheet pattern pieces away from the cutting surface 24 with one hand while reaching under the textile material 10 with the other hand to move, rearrange, and exactly reposition the magnetically attractable objects, which location may be determined by observing the concurrent movement of the magnetic objects along the upper surface of the thin paper sheet pattern piece. This moving, rearranging and repositioning should be performed with the view of bringing each of the magnetically attractable objects and the magnetic objects attracted thereto within at least two inches but no less than one inch from the interior of the cutting line 14. This movement results in the rearrangement, as shown in FIG. 1, from the original positions as shown in phantom to the final positions as shown with solid and dotted lines. Preferably, these magnetically attractable objects and magnetic objects should be so distributed as to provide uniform retention of the thin paper sheet pattern piece 12 against the textile material 10. By keeping these objects at least one inch away from the cutting line 14, any undue attraction to a cutting means such as metal scissors or electronic cutting devices will be avoided. On the other hand, by allowing these objects to extend no more than two inches into the center of the pattern piece, avoidance with interior dart lines 15 such as those shown in FIG. 1, is avoided. At this stage in the cutting of the garment-pattern shaped piece, it may be desirable to slide tracing paper between the thin paper sheet pattern piece 12 and the textile material 10. It may be observed that within the interior of the thin paper sheet pattern piece 12, there are no pins or other obstructions which will prevent the quick and easy tracing of the dart lines 15 on the textile fabric 10.

Once the previous steps have been accomplished, the fabric is now ready for cutting using any cutting means normally known to the art such as scissors or electromechanical cutting means which may be used to cut the textile material and the thin paper sheet pattern piece along the cutting line 14.

Figure 5:
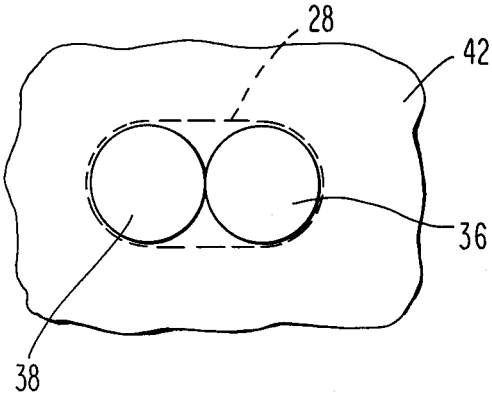
FIG. 5 is a cut away plan view of a pattern showing two magnetic objects in association with one magnetically attractable object.

According to one alternate embodiment of the present invention, should the thickness of the textile material be so great as to render the preferred embodiment unsatisfactory or undesirable, a plurality of magnetic objects may be used in association with each magnetically attractable object. For a plate 28 such as shown in FIG. 3, it is clear that two magnetic objects 36 and 38 may be placed in association with that plate in order to double the gripping force which is exerted on the textile material and the thin paper sheet pattern piece 12. This embodiment is illustrated in FIG. 5.

Similarly, another alternate embodiment of the present invention which is intended to increase the force exerted upon the textile material 10 and the thin paper sheet pattern piece 12 is the utilization of a magnet 36 in conjunction with a magnetic object 34, such as shown in FIG. 4.

Figure 6:
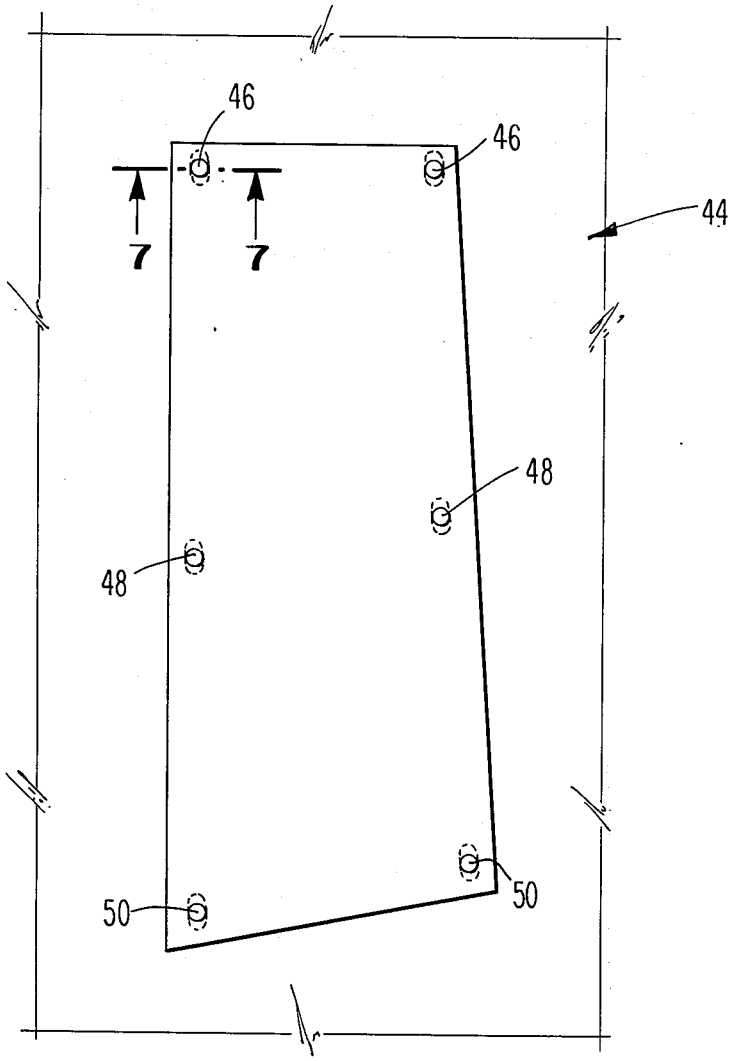
FIG. 6 is a plan view of a composite pattern piece which is stored on a vertical surface as indicated by a foreshortened outline.
Figure 7:
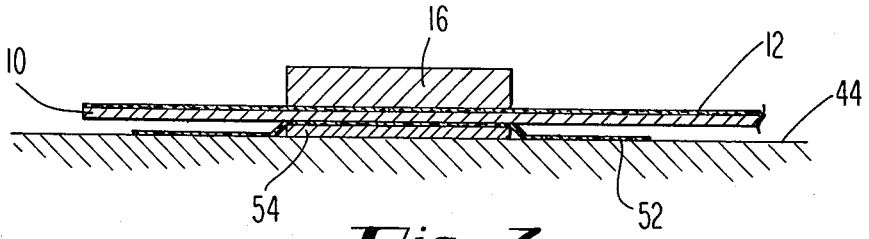
FIG. 7 is an enlarged cross section of a portion of the composite pattern piece and one of the holding sets used to hold the composite pattern piece in its vertical position as taken along line 7—7 shown in FIG. 6.

Following the cutting of the textile material and thin paper sheet pattern piece along the cutting line, as described above, the magnetic objects 16 may be removed by lifting the thin paper sheet pattern piece 12 from the textile material 10, thereby producing a garment-pattern shaped piece of textile material which may be utilized immediately in the fabrication of a garment. According to an alternate embodiment of the present invention, however, it may not be desirable to immediately remove the magnetic objects and the thin paper sheet pattern pieces, as this removal will also remove the designation which identifies and distinguishes each of these garment-pattern shaped pieces. Consequently, according to an alternate embodiment of the present invention, the composite pattern pieces comprising the textile material 10, the thin paper sheet pattern piece 12, the magnetic objects 16, and the magnetically attractable objects 20 may be stored in a vertical position prior to their intended use. This storage of the composite pattern pieces is illustrated in FIG. 6, which shows a vertical surface such as a wall, door, or other substantially vertical surface on which is stored a composite pattern piece. According to the embodiment shown in FIGS. 6 and 7, holding set plates 54 may be affixed to a substantially vertical substrate 44 by using a thin adhesive tape 52 which extends along the vertical substrate over the holding said plate and again along the vertical substrate. Alternatively, these plates may be replaced by a large magnetically attractable surface, such as a metal door, or metal surface which has been mounted over the substantially vertical substrate 44, in which case the substantially vertical substrate, would in itself, become magnetically attractable. According to the teaching of these embodiments, following the cutting operation to form the composite pattern pieces, the composite pattern pieces would be removed intact from the cutting surface and transferred to the vertical position. In the case of the holding set plates 54 shown in FIGS. 6 or 7, the magnetically attractable objects 20 would be replaced individually by the holding set plate and the magnetic objects 16 would be employed to attract the holding set plate 54 in order to grip the thin paper sheet pattern piece 12 and textile material 10 therebetween. As shown in FIG. 6, a plurality of holding sets 46, 48, and 50 are shown holding one composite pattern piece in a vertical position along the substantially vertical substrate 44. Using the alternate embodiment of the present invention shown in FIG. 4, it would not be necessary to replace the magnetically attractable object 20, but rather the composite pattern piece could simply be transferred to the vertical substrate 44 from the cutting substrate 30 for immediate storage. In addition to protection from damage and soiling in this position, it should be pointed out that the storage of fabric in a vertical position is likely to prevent the distortion of the shape of the pattern piece due to undesired forces such as might be encountered in other storage operations. Furthermore, creasing, folding, or other deformities are less likely to occur to the fabric when hung in such a position. It should be further noted, that where a vertical substrate which is magnetically attractable is provided, the holding set plate 54 and tape 52 may be dispensed with entirely.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a nonlegal technical statement of the contents of the disclosure in compliance with the Rules of Practice of the U.S. Patent Office, and is not intended to limit the scope of the invention described and claimed herein.

I claim:

1. A method of cutting textile material into garment pattern shaped pieces using thin paper pattern pieces having a cutting line inscribed thereon which conforms to the desired pieces to be cut comprising the steps of:

a. placing at least four distinct substantially planar magnetically attractable objects on a substantially horizontal planar cutting surface;

b. placing textile material over said magnetically attractable objects;

c. positioning and placing a thin paper sheet pattern piece directly over said material above the location of said magnetically attractable objects;

d. successively placing a plurality of magnetic objects, at least one for each magnetically attractable object, on the surface of said thin paper sheet pattern piece, each step of placing one of said magnetic objects including first juxtaposing said one magnetic object axially above an associated attractable object at a distance of at least one inch from said associated magnetically attractable object, and then releasing said one magnetic object, thereby allowing said one magnetic object to reorient itself during the gravitationally induced movement towards its associated magnetically attractable object, such that said magnetically attractable objects and said magnetic objects are attracted to each other and grip both the textile material and thin paper sheet pattern piece therebetween;

e. simultaneously gripping said textile and exerting a substantially planar divergent force on said pattern piece thereby displacing said pattern piece along said textile to a desired cutting location;

f. slightly lifting said textile material and said thin paper sheet pattern piece away from said cutting surface while moving, re-arranging, and exactly re-positioning said magnetically attractable objects to said location, said step of moving, re-arranging, and re-positioning including observing the concurrent movement of said magnetic objects along the upper surface of said thin paper sheet pattern piece while displacing said attractable objects therebelow, said moving and re-arranging bringing each of the magnetically attractable objects and the magnetic objects attracted thereto to within at least two inches but no less than one inch from the interior of said cutting line;

g. cutting said textile material and said thin paper sheet pattern piece along said cutting line to form composite pattern pieces; and h. removing said magnetic objects and lifting said thin paper sheet pattern piece from said material, thereby producing a garment-pattern shaped piece of textile material.

2. The method of claim 1, wherein said step of successively placing comprises successively repeating said juxtaposing and releasing steps at least twice for each of said attractable objects, whereby at least two magnetic objects are allowed to grip each magnetically attractable object.

3. The method of claim 1, and further comprising the steps of storing said composite pattern pieces in a substantially vertical position by providing a vertical surface which is at least partly magnetically attractable, removing each composite pattern piece from the cutting surface, transferring the composite pattern piece to the vertical position against said vertical surface, and placing said magnetic objects against the composite pattern piece at the location of magnetically attractable portions of said vertical surface to retain said composite pattern piece in the vertical position through magnetic attraction to those portions of the vertical surface which are magnetically attractable.

* * * * *